US008485713B2

(12) United States Patent
Atalay

(10) Patent No.: US 8,485,713 B2
(45) Date of Patent: Jul. 16, 2013

(54) OVEN LAMP HOLDER WITH BAYONET LOCK

(75) Inventor: Suavi Atalay, Istanbul (TR)

(73) Assignee: Zafer Ulus, Osmanfazi Bursa (TR)

( * ) Notice: Subject to any disclaimer, the term of this patent is extended or adjusted under 35 U.S.C. 154(b) by 192 days.

(21) Appl. No.: 13/061,259

(22) PCT Filed: Jul. 30, 2009

(86) PCT No.: PCT/TR2009/000094

§ 371 (c)(1),
(2), (4) Date: Feb. 28, 2011

(87) PCT Pub. No.: WO2010/024788

PCT Pub. Date: Mar. 4, 2010

(65) Prior Publication Data

US 2011/0149552 A1 Jun. 23, 2011

(30) Foreign Application Priority Data

Sep. 1, 2008 (TR) ..... a 2008 06540

(51) Int. Cl.
*F21V 7/04* (2006.01)

(52) U.S. Cl.
USPC ..... 362/651; 362/402

(58) Field of Classification Search
USPC ..... 362/401–402, 440, 249.01, 647, 362/649–652, 655, 656, 92, 374, 375; 439/336, 439/332, 335, 666
See application file for complete search history.

(56) References Cited

U.S. PATENT DOCUMENTS

| | | | | |
|---|---|---|---|---|
| 6,461,010 | B1 | 10/2002 | Knight et al. | |
| 7,422,341 | B2 * | 9/2008 | Henrici et al. | 362/92 |
| 7,976,211 | B2 * | 7/2011 | Cao | 362/650 |
| 2005/0194607 | A1 * | 9/2005 | Barnett et al. | 257/99 |
| 2007/0217228 | A1 * | 9/2007 | Tseng | 362/649 |

FOREIGN PATENT DOCUMENTS

| | | | |
|---|---|---|---|
| EP | 10500865 | A | 1/2005 |
| EP | 1811227 | A | 7/2007 |

* cited by examiner

*Primary Examiner* — Julie Shallenberger
(74) *Attorney, Agent, or Firm* — Porzio, Bromberg & Newman, P.C.

(57) ABSTRACT

The present invention relates to a lamp holder with bayonet lock that provides interior illumination in kitchen equipment or similar devices, particularly in domestic ovens, and it is characterized in that it consists of (i) plastic or porcelain body (2) with screw ring housing (10) and terminal rivet hole (12) on its inner surface, and mounting recesses (13), mounting protrusions (13a) and positioning wedge (11) on its outer surface; (ii) mounting frame (3) with circular inner and outer diameter and located on the plastic or porcelain body (2), and having springy mounting pins (14) seated at an angle of 180° from each other on its inner side, springy mounting hooks (14*a*), locking pins (15) and locking springs (16); and (iii) glass enclosure (1) located on the mounting frame (3) shaped in almost semi-spherical form and equipped with a glass enclosure flange (7) on the bottom part, fixing slots (8) in pairs and locking track (9) below the glass enclosure flange (7).

7 Claims, 5 Drawing Sheets

OVEN LAMP HOLDER WITH BAYONET LOCK

CROSS REFERENCE TO RELATED APPLICATION:

This is a National Stage of International Application No. PCT/TR2009/000094, filed 30 Jul. 2009, which claims the benefit of Application No. 2008/06540, filed in Turkey on 1 Sep. 2008, the disclosures of which Applications are incorporated by reference herein.

The present invention relates to a lamp holder with bayonet lock designed to be used in kitchen appliances, for instance ovens.

In the current technology, a typical in-oven lamp holder fits into a mounting hole punched on the interior cabinet wall of an oven. The mounting hole on the interior cabinet wall of an oven can be in circular, rectangular or other special forms depending on the lamp holder design.

Typical lamp holder used inside the oven consists of three components. These are i) glass enclosure protecting the bulb from outer impacts as well as the chemical effects of water vapor, gas and particles produced inside the oven; ii) porcelain or plastic lamp holder body bearing contacts and terminals on which the bulb is mounted, and iii) mounting frame in ring or tube form that holds the glass enclosure and at the same time ensures the installation of the whole lamp holder to oven interior cabinet.

Today, screwed, interlocked or bayonet locking systems are employed to couple the glass enclosure to the mounting frame. In interlocked assemblies, the glass enclosure is coupled to the mounting frame by tight fitting into locks on the mounting frame or anchored to the mounting frame by metal hooks. Such a system requires a wider mounting surface compared to other systems and also the user is forced to disassemble fasteners such as hooks to replace the bulb. In the screwed mounting system; screw threads are present on the glass enclosure at such an angle to ensure auto blockage, and the glass enclosure is coupled to the mounting sheet via threads. However, due to structural reasons, the glass enclosure sticks to the mounting sheet after some usage cycles because of thermo-mechanical stresses and chemical reactions depending on the operation of the oven. For this reason, it may become impossible for the user to remove the glass enclosure for bulb replacement. The bayonet coupling system avoids the disadvantages of interlocked and screwed system, because the bayonet system can be applied to mounting frames shaped with various methods. However, as applications so far require a serial processes in manufacturing the frame, a particular manufacturing cost burden is applicable.

The present invention that relates to a lamp holder with bayonet lock that provides interior illumination in kitchen equipment or similar devices, particularly in domestic ovens fully overcomes the abovementioned disadvantages, and it is characterized in that it consists of i) glass enclosure constructed in semi-speherical form, ii) metal mounting frame that is practically manufactured in cutting and bending tools and iii) a plastic or ceramic body.

The lamp holder with bayonet lock is an easily manufactured useful product having superior technical features for kitchen equipment designed to avoid the sticking of glass enclosure to the metal mounting frame.

The glass enclosure moves radially over the metal mounting frame to get coupled to it. The metal mounting frame is fixed on a plastic or porcelain frame by means of springy mounting pins and springy mounting hooks.

The present invention is now described in detail with reference to the accompanying exemplifying drawings, wherein.

DESCRIPTION OF REFERENCES

Figure 1:
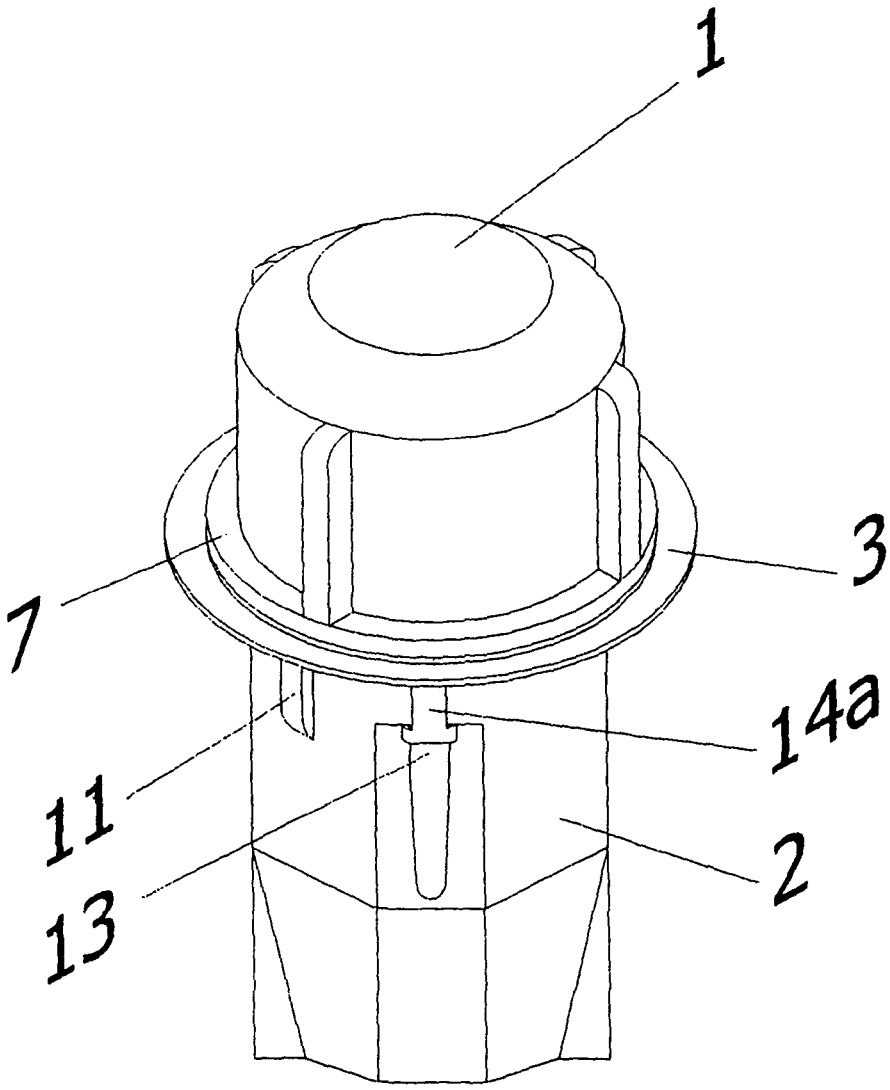
FIG. 1 is the assembled view of lamp holder with bayonet lock
Figure 2:
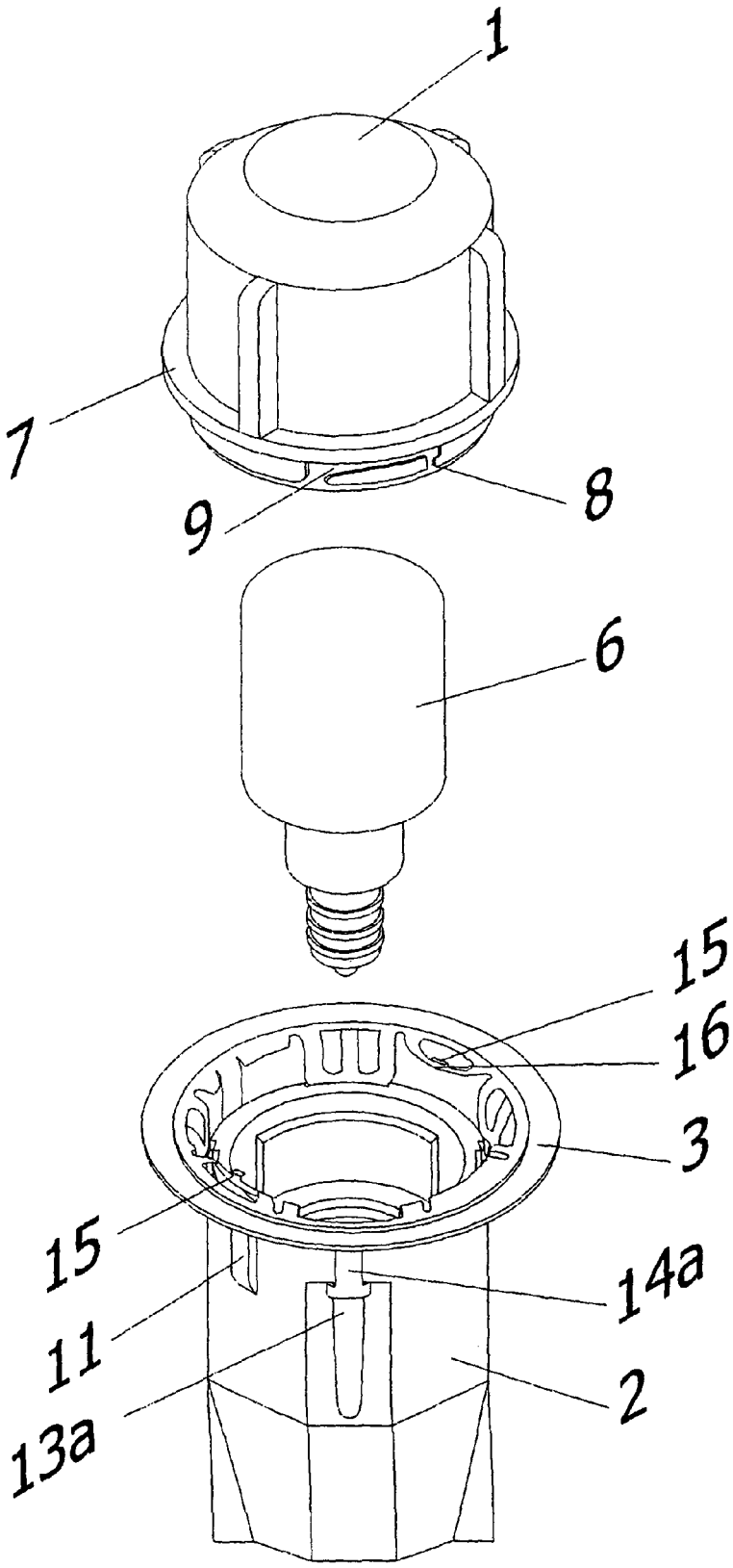
FIG. 2 is the view of the lamp holder with bayonet lock with bulb and glass enclosure unattached
Figure 3:
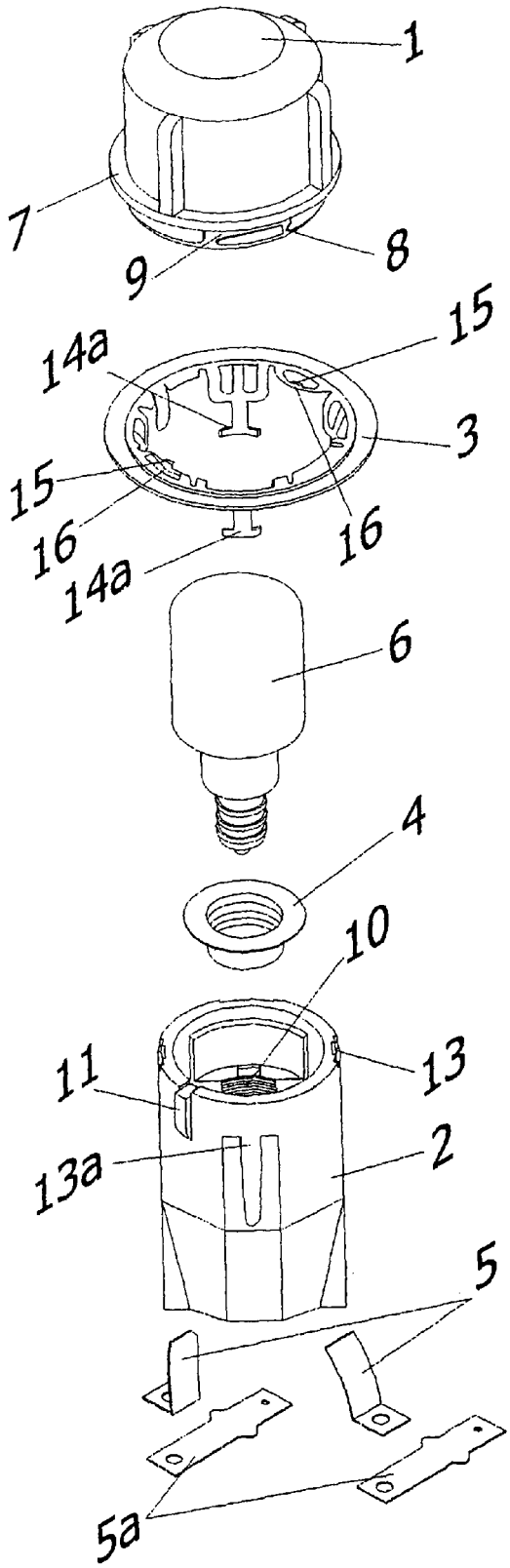
FIG. 3 is the exploded with of the lamp holder with bayonet lock
Figure 4:
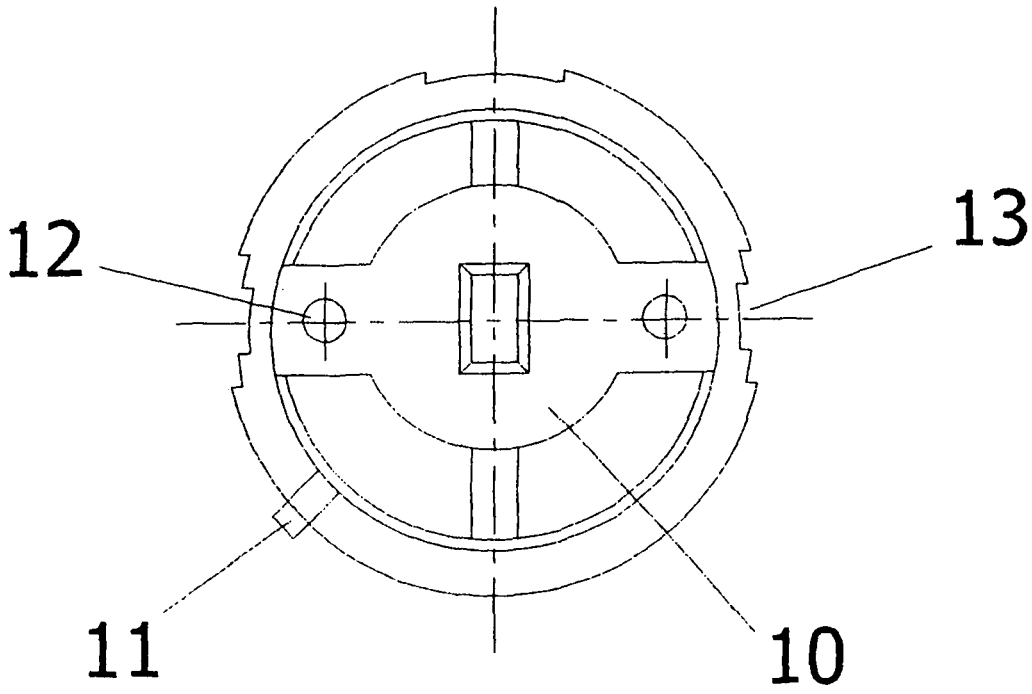
FIG. 4 is the top view of the plastic and porcelain body FIG. 5—various views of the mounting frame
Figure 5:
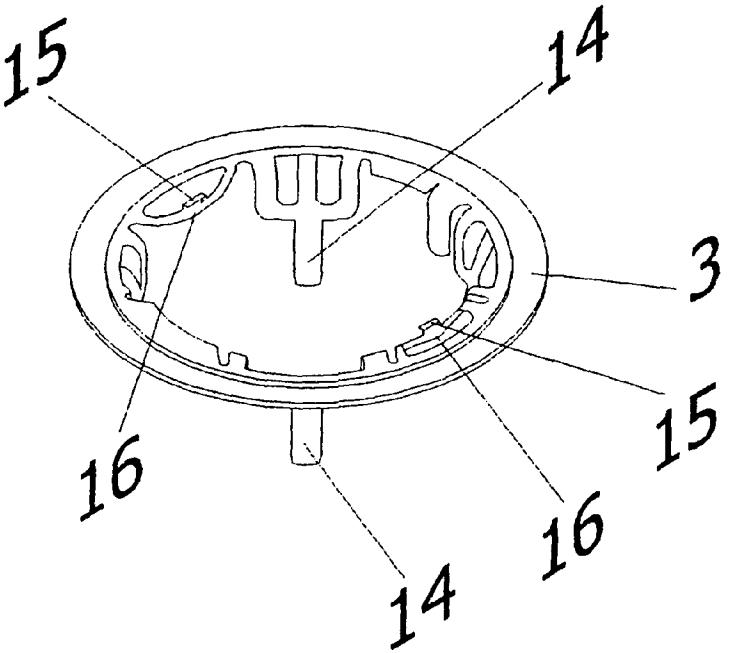
Figure 5:
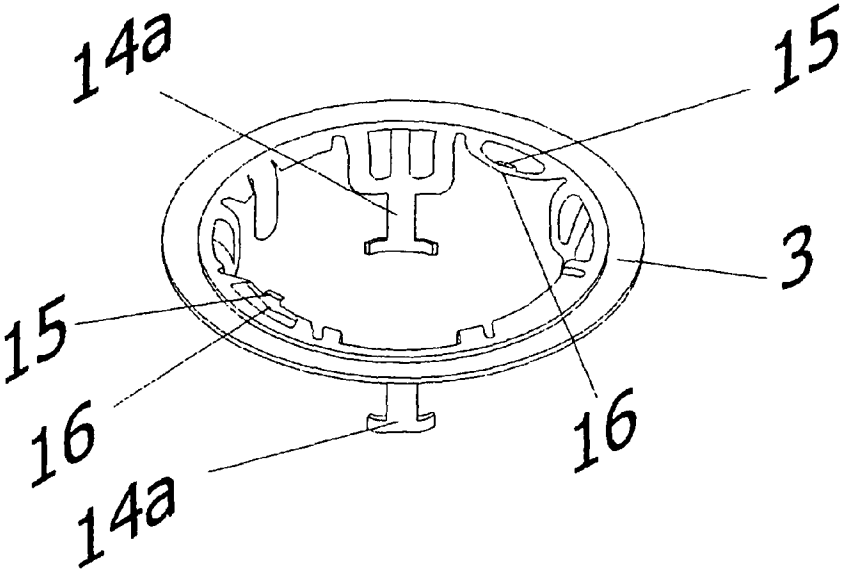

| NO | PART NAME |
|---|---|
| 1 | Glass enclosure |
| 2 | Plastic or porcelain body |
| 3 | Mounting frame |
| 4 | Screw ring |
| 5 | Contact |
| 5a | Terminal |
| 6 | Bulb |
| 7 | Glass enclosure flange |
| 8 | Fixing slot |
| 9 | Locking track |
| 10 | Screw ring housing |
| 11 | Positioning wedge |
| 12 | Terminal rivet hole |
| 13 | Mounting recess |
| 13a | Mounting protrusion |
| 14 | Springy mounting pin |
| 14a | Springy mounting hook |
| 15 | Locking pins |
| 16 | Locking spring |

In the invention, the glass enclosure (1) is shaped in almost semi-spherical form and equipped with a glass enclosure flange (7) on the bottom part. Just beneath the glass enclosure flange (7) are locking tracks (9) opened radially in pairs and a stop position slot (8).

The plastic or porcelain body (2) is made of plastic or ceramic depending on the operating temperature and serves as a housing to the light bulb (6). Inside the plastic or porcelain body (2) are a screw ring housing (10) and terminal rivet holes (12); and on its outside surface are mounting recess (13), mounting protrusion (13*a*) and positioning wedge (11).

Mounting frame (3) is made of metal sheet using cutting and bending tools, and its inner and outer diameters are in circular form. On the inner side of the mounting frame (3) are resilient mounting pin (14), resilient mounting hook (14*a*), locking pins (15) and locking spring (16) located at an angle of 180° from each other. Mounting pin (15) and locking spring (16) ensure the operation of the bayonet locking system.

Contacts are seated on terminal rivet holes (12) located below the plastic or porcelain body (2) and riveted with the terminals (5*a*). And on the screw ring housing (10), the screw ring (4) is seated and fixed.

The mounting frame (3) is seated on the plastic or porcelain body (2), hence the resilient mounting pins (14) located at an angle of 180° on inner sides of the mounting frame (3) can get clutched into the mounting recesses (13) on the outer surface of the plastic or porcelain body (2), and the resilient mounting hooks (14*a*) located at an angle of 180° on the inner sides of the mounting sheet frame (3) can get clutched into the mounting protrusions (13*a*) on the outer surface of the plastic or porcelain body (2). Hence, the mounting frame (3) clasps the plastic or porcelain body (2) at a fixed position. Bulb (6) is attached to the screw ring (4) fixed into the plastic or porcelain body (2). After the bulb (6) is attached, the glass enclosure (1) is seated on the mounting frame (3) fixed on the plastic or porcelain frame (2). Thanks to this seating position, the glass enclosure flange (7) on the bottom side of the glass enclosure (1) contacts frontally with the top surface of mounting frame (3). When the glass enclosure (1) is rotated over the mounting frame (3), the locking pins (15) located at an angle of 180° on the inner side of the mounting frame (3) moves through the locking tracks (9) opened radially. After this motion, the locking springs (16) retaining their geometrical position seat on the fixing slots (8), allowing the glass enclosure (1) to get fixed to mounting frame on the plastic or porcelain body (2), preventing the glass enclosure (1) from becoming loose without force.

Thanks to the frontal contact between the glass enclosure flange (7) on the bottom part of the glass enclosure (1) and the mounting frame (3), substances in solid, liquid and gas form inside the oven are prevented from permeating into the plastic or porcelain body (2) hosting the bulb (6).

Finally, after the assembled lamp holder is installed into the panel cut-out of the oven interior cabinet , electrical connections are completed through terminals (5*a*). The positioning wedge (11) on the outer surface of the plastic or porcelain body (2) ensures fixing of the plastic or porcelain body (2) into interior cabinet of any kitchen equipment at a certain position.

The invention claimed is:

1. A lamp holder with bayonet lock comprising a plastic or porcelain body with a screw ring housing and terminal rivet hole on its inner surface, and mounting recesses, mounting protrusions and a positioning wedge on its outer surface; a mounting frame with a circular inner and outer diameter and located on the plastic or porcelain body, and having resilient mounting pins and resilient mounting hooks, seated at an angle of 180° from each other on its inner side, locking pins and locking springs; a glass enclosure located on the mounting frame is shaped in almost semi-spherical form and equipped with a glass enclosure flange on the bottom part and positioning slots in pairs and a locking track below the glass enclosure flange.

2. The lamp holder with bayonet lock according to claim 1 wherein the locking springs are positioned over the positioning slots and the positioning slots are radially positioned below the glass enclosure flange.

3. The lamp holder with bayonet lock according to claim 1 wherein the screw ring housing includes a screw ring adapted to received a bulb.

4. The lamp holder with bayonet lock according to claim 1 wherein the resilient mounting pins are located in the mounting recesses on the outer surface of the plastic or porcelain body.

5. The lamp holder with bayonet lock according to claim 1 wherein the resilient mounting hook are located on the mounting protrusions on the outer surface of the plastic or porcelain body.

6. A lamp holder with bayonet lock according to claim 1 wherein the locking pin is downwardly inclined with respect to a top surface of the mounting frame and located on an inner periphery of the mounting frame and when the glass enclosure coupled to the mounting frame becomes in touch with a lower wall of the locking track and therefore pushes the glass enclosure flange against the top surface of the mounting frame providing a mechanical sealing between the glass enclosure flange and the mounting frame and providing a friction between the glass enclosure and the mounting frame which prevents the glass enclosure from becoming loose undesirably.

7. A lamp holder with bayonet lock comprising:

a body;

a mounting frame located on the body having resilient mounting pins and resilient mounting hooks;

locking pins and locking springs;

a glass enclosure located on the mounting frame and equipped with a glass enclosure flange on the bottom part and positioning slots in pairs and a locking track below the glass enclosure flange; the locking pins are downwardly inclined with respect to a top surface of the mounting frame and located on an inner periphery of the mounting frame, and when the glass enclosure coupled to the mounting frame becomes in touch with a lower wall of the locking track and therefore pushes the glass enclosure flange against the top surface of the mounting frame providing a mechanical sealing between the glass enclosure flange and the mounting frame and providing a friction between the glass enclosure and the mounting frame which prevents the glass enclosure from becoming loose undesirably.

* * * * *